US012716164B1

(12) United States Patent
Elcock

(10) Patent No.: US 12,716,164 B1
(45) Date of Patent: Aug. 25, 2026

(54) CLOTHES DRYER EXHAUST REDIRECTION SYSTEM

(71) Applicant: Nigel Elcock, Feasterville Trevose, PA (US)

(72) Inventor: Nigel Elcock, Feasterville Trevose, PA (US)

( * ) Notice: Subject to any disclaimer, the term of this patent is extended or adjusted under 35 U.S.C. 154(b) by 546 days.

(21) Appl. No.: 18/242,073

(22) Filed: Sep. 5, 2023

(51) Int. Cl.

| | |
|---|---|
| ***D06F 58/10*** | (2006.01) |
| ***D06F 58/20*** | (2006.01) |
| ***D06F 58/22*** | (2006.01) |
| ***F26B 25/00*** | (2006.01) |
| *D06F 103/56* | (2020.01) |
| *D06F 105/18* | (2020.01) |
| *D06F 105/32* | (2020.01) |
| *D06F 105/58* | (2020.01) |

(52) U.S. Cl.
CPC ..... *D06F 58/10* (2013.01); *D06F 58/22* (2013.01); *D06F 2103/56* (2020.02); *D06F 2105/18* (2020.02); *D06F 2105/32* (2020.02); *D06F 2105/58* (2020.02)

(58) Field of Classification Search
CPC ..... D06F 58/10; D06F 58/20; D06F 58/22; F26B 25/007
USPC ..... 34/79, 90, 604, 86, 131, 106
See application file for complete search history.

(56) References Cited

U.S. PATENT DOCUMENTS

| | | | | |
|---|---|---|---|---|
| 3,417,481 | A * | 12/1968 | Rumsey, Jr. | D06F 58/203 223/51 |
| 3,859,725 | A | 1/1975 | Katterjohn | |
| 3,959,892 | A | 6/1976 | Cloud | |
| 4,011,662 | A * | 3/1977 | Davis | F26B 25/007 34/90 |
| 4,106,214 | A | 8/1978 | Schmidt | |
| 4,380,126 | A | 4/1983 | Kinder | |
| 4,395,831 | A | 8/1983 | Nielsen | |
| 4,530,170 | A * | 7/1985 | Green | D06F 58/20 34/235 |
| 5,107,603 | A | 4/1992 | Durazzani | |
| D919,077 | S | 5/2021 | Benz | |

FOREIGN PATENT DOCUMENTS

| | | |
|---|---|---|
| GB | 2248289 | 12/1994 |

* cited by examiner

*Primary Examiner* — Deming Wan
(74) *Attorney, Agent, or Firm* — Kyle A. Fletcher, Esq.

(57) ABSTRACT

The clothes dryer exhaust redirection system includes a tee fitting, U-shaped ductwork, a lint filter, a lint trap, a first blast gate, a second blast gate, a first air sensor, and a second air sensor. The clothes dryer exhaust redirection system may recover heat from the exhaust of an electric dryer by redirecting the heat into a building where the electric dryer is located. The tee fitting may couple to an exhaust outlet of the electric dryer and may direct heated air out of the building via an exhaust duct, into the building via the U-shaped ductwork, or a combination thereof. The lint trap and the lint filter may prevent lint from entering the building. As a non-limiting example, the heated air may warm the interior of the building during the winter.

19 Claims, 3 Drawing Sheets

CLOTHES DRYER EXHAUST REDIRECTION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of exhaust heat reclamation clothes dryer accessories, more specifically, a clothes dryer exhaust redirection system.

SUMMARY OF INVENTION

The clothes dryer exhaust redirection system comprises a tee fitting, U-shaped ductwork, a lint filter, a lint trap, a first blast gate, a second blast gate, a first air sensor, and a second air sensor. The clothes dryer exhaust redirection system may recover heat from the exhaust of an electric dryer by redirecting the heat into a building where the electric dryer is located. The tee fitting may couple to an exhaust outlet of the electric dryer and may direct heated air out of the building via an exhaust duct, into the building via the U-shaped ductwork, or a combination thereof. The lint trap and the lint filter may prevent lint from entering the building. As a non-limiting example, the heated air may warm the interior of the building during the winter.

An object of the invention is to provide a tee fitting to split the flow of heated air exiting an electric clothes dryer into a path that continues out of the building via an exhaust duct and a path that redirects the heated air into the building via a U-shaped ductwork comprising a duct flare.

Another object of the invention is to provide a first blast gate and a second blast gate to control the path of the heated air through the exhaust duct and through the U-shaped ductwork.

A further object of the invention is to provide a first air sensor and a second air sensor to detect high pressure that may be indicative of a duct blockage or improper setting of the first blast gate and/or second blast gate.

Yet another object of the invention is to provide a lint trap and a lint filter to capture lint passing through the U-shaped ductwork before the lint may be blown into the building.

These together with additional objects, features and advantages of the clothes dryer exhaust redirection system will be readily apparent to those of ordinary skill in the art upon reading the following detailed description of the presently preferred, but nonetheless illustrative, embodiments when taken in conjunction with the accompanying drawings.

In this respect, before explaining the current embodiments of the clothes dryer exhaust redirection system in detail, it is to be understood that the clothes dryer exhaust redirection system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the clothes dryer exhaust redirection system.

It is therefore important that the claims be regarded as including such equivalent construction insofar as they do not depart from the spirit and scope of the clothes dryer exhaust redirection system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
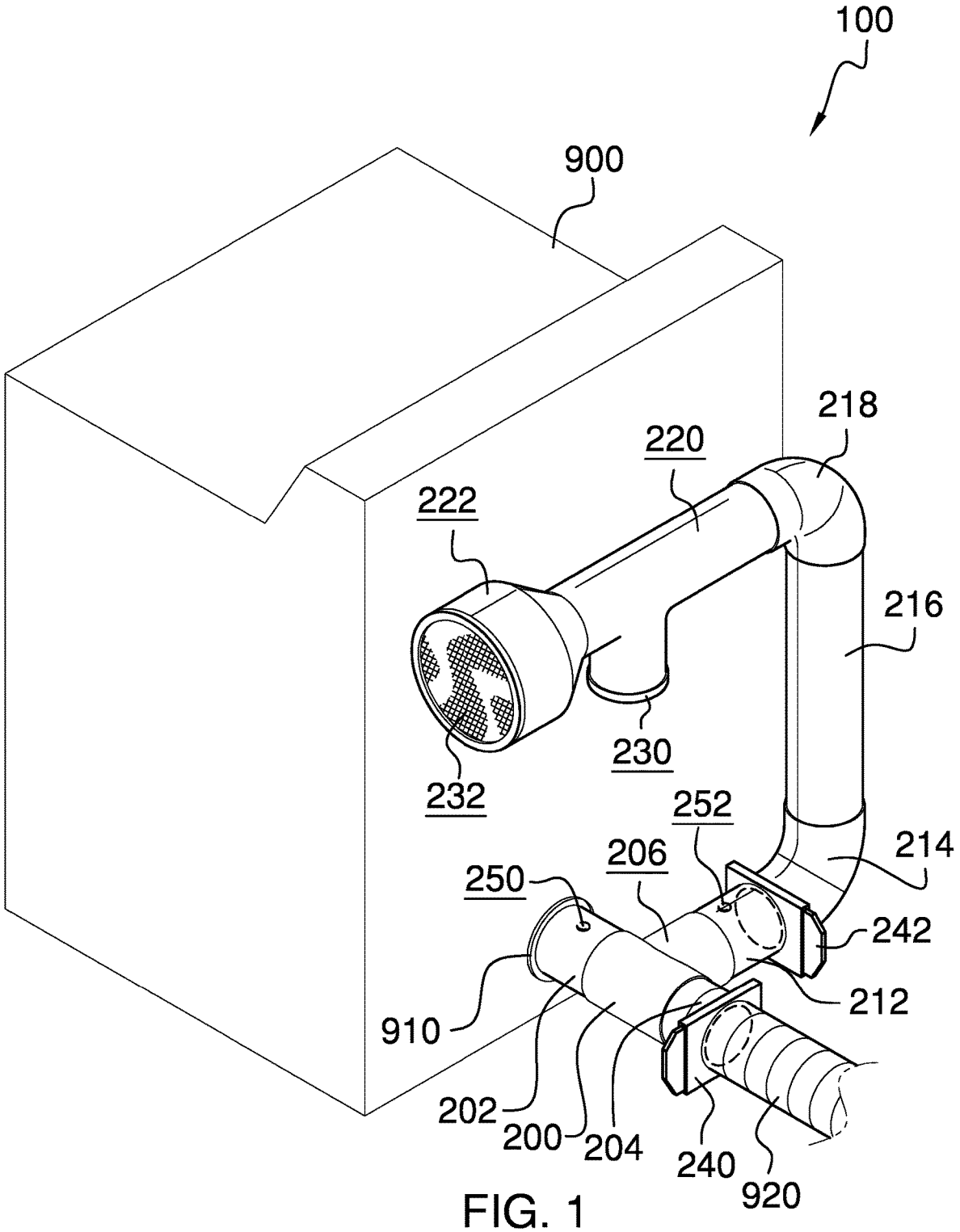
FIG. 1 is an isometric view of an embodiment of the disclosure.
Figure 2:
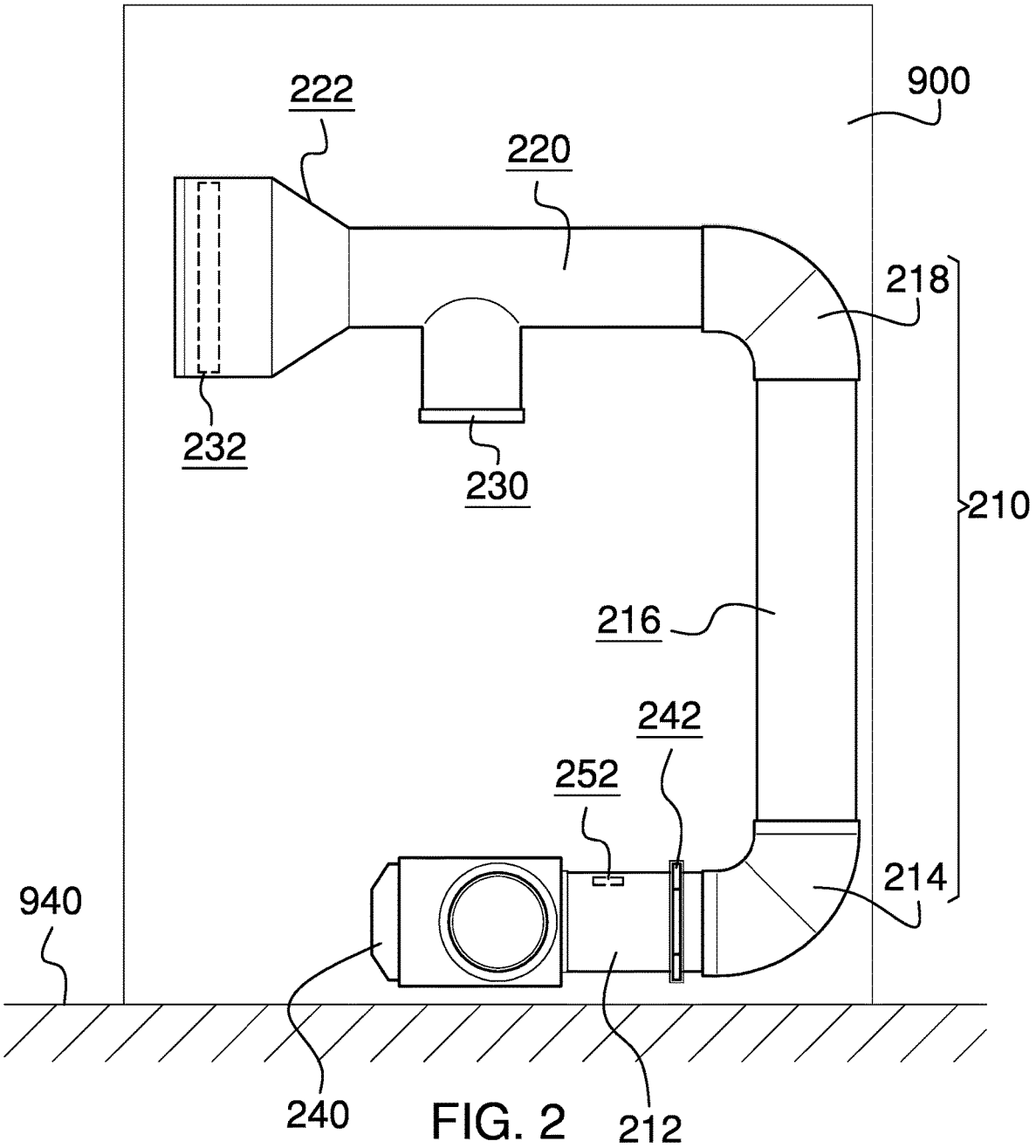
FIG. 2 is a top view of an embodiment of the disclosure.
Figure 3:
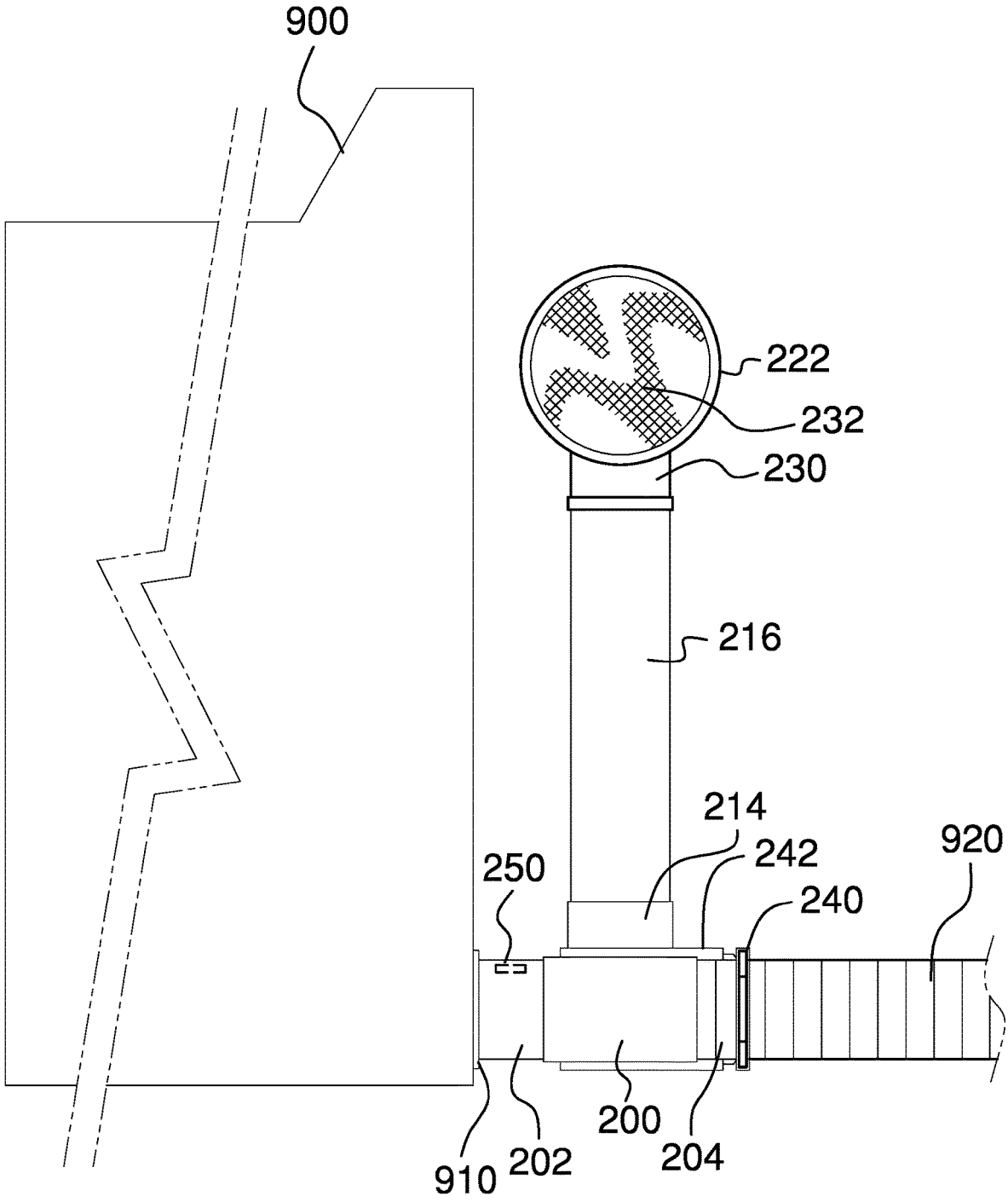
FIG. 3 is a front view of an embodiment of the disclosure.

Detailed reference will now be made to a first potential embodiment of the disclosure, which is illustrated in FIGS. 1 through 3.

The clothes dryer exhaust redirection system 100 (hereinafter invention) comprises a tee fitting 200, U-shaped ductwork 210, a lint filter 232, a lint trap 230, a first blast gate 240, a second blast gate 242, a first air sensor 250, and a second air sensor 252. The invention 100 may recover heat from the exhaust of an electric dryer 900 by redirecting the heat into a building where the electric dryer 900 is located. The tee fitting 200 may couple to an exhaust outlet 910 of the electric dryer 900 and may direct heated air out of the building via an exhaust duct 920, into the building via the U-shaped ductwork 210, or a combination thereof. The lint trap 230 and the lint filter 232 may prevent lint from entering the building. As a non-limiting example, the heated air may warm the interior of the building during the winter.

The tee fitting 200 may comprise a tee input port 202, a first tee output port 204, and a second tee output port 206.

The tee input port 202 may detachably couple to the exhaust outlet 910 of the electric dryer 900 such that the heated air expelled from the electric dryer 900 may enter the tee fitting 200. The heated air may pass through the tee fitting 200 and may exit via the first tee output port 204, the second tee output port 206, or both.

The exhaust duct 920 may detachably couple to the first tee output port 204. The first tee output port 204 may be aligned with the tee input port 202 such that the heated air exiting through the first tee output port 204 may pass straight through the tee fitting 200 to the first tee output port 204 and may be directed out of the building via the exhaust duct 920.

The second tee output port 206 may be oriented to be perpendicular to the tee input port 202 and the central axis of the second tee output port 206 is oriented to be parallel to the floor 940.

The U-shaped ductwork 210 may be coupled to the second tee output port 206 such that the heated air exiting the tee fitting via the second tee output port 206 may pass into the U-shaped ductwork 210. The U-shaped ductwork 210 may direct the heated air to an elevated position behind the electric dryer 900 where the heated air may be released into the building.

The U-shaped ductwork 210 may comprise a lower lateral duct 212, a first elbow 214, a vertical duct 216, a second elbow 218, and an upper lateral duct 220. The lower lateral duct 212 may couple to the second tee output port 206 and may be oriented parallel to the floor 940. The lower lateral duct 212 may direct the heated air from the tee fitting 200 to the first elbow 214. The first elbow 214 may couple the lower lateral duct 212 to the vertical duct 216. The vertical duct 216 may be vertically-oriented and may direct the heated air up to the second elbow 218. The second elbow 218 may couple the vertical duct 216 to the upper lateral duct 220. The upper lateral duct 220 may be horizontally-oriented and may direct the heated air back across the rear of the electric dryer 900.

The distal end of the upper lateral duct 220 may terminate at a duct flare 222. The duct flare 222 may alter the velocity and pressure of the heated air in preparation for releasing the heated air into the building. As a non-limiting example, the duct flare 222 may reduce the velocity of the heated air.

In some embodiments, the U-shaped ductwork 210 may be supported by one or more straps that detachably couple to the rear of the electric dryer 900

The lint filter 232 may detachably couple to the duct flare 222 such that the heated air exiting through the duct flare 222 must pass through the lint filter 232. The lint filter 232 may retain the lint that may otherwise be blown into the building.

The lint trap 230 may be coupled to the underside of the upper lateral duct 220. The lint trap 230 may be configured to collect the lint that may be blown through the U-shaped ductwork 210. In some embodiments, the lint trap 230 may detach from the lower lateral duct 212 such that the lint trap 230 may be emptied and re-attached. As a non-limiting example, the lint trap 230 may threadedly couple to a fitting located on the bottom of the upper lateral duct 220.

The first blast gate 240 may be a gate valve that may be opened and closed to control the flow of the heated air through the exhaust duct 920. The first blast gate 240 may be located where the first tee output port 204 couples to the exhaust duct 920. The first blast gate 240 may be adapted to be opened by a user to pass the heated air from the tee input port 202 to the exhaust duct 920. The first blast gate 240 may be adapted to be closed by the user to block the heated air from flowing into the exhaust duct 920.

The second blast gate 242 may be a gate valve that may be opened and closed to control the flow of the heated air through the U-shaped ductwork 210. The first blast gate 240 may be located where the second tee output port 206 couples to the U-shaped ductwork 210. The second blast gate 242 may be adapted to be opened by the user to pass the heated air from the tee input port 202 to the U-shaped ductwork 210. The second blast gate 242 may be adapted to be closed by the user to block the heated air from flowing into the U-shaped ductwork 210.

The first air sensor 250 may be located on the tee input port 202 such that the first air sensor 250 may monitor the heated air flowing into the tee fitting 200. The second air sensor 252 may be located on the second tee output port 206 such that the second air sensor 252 may monitor the heated air flowing out of the tee fitting 200 and into the U-shaped ductwork 210.

An individual air sensor selected from the first air sensor and the second air sensor 252 may monitor the pressure of the heated air that is flowing past the individual air sensor. The individual air sensor may comprise one or more predetermined pressure thresholds that may define a range for nominal operating pressure and at least one problematic pressure threshold. In some embodiments, the pressure may exceed the at least one problematic pressure threshold during a blockage of airflow within the invention 100. As non-limiting examples, the pressure within the invention 100 may exceed the at least one problematic pressure threshold due to a buildup of the lint within the exhaust duct 920 or within the U-shaped ductwork 210, because both the first blast gate 240 and the second blast gate 242 are closed, or any combination thereof.

The individual air sensor may be adapted to alert the user when the pressure exceeds the at least one problematic pressure threshold. As non-limiting examples, the individual air sensor may comprise an audio transducer that may produce an audible sound, the individual air sensor may communicate with an alarm panel, either wirelessly or over wires, such that the alarm panel may take action to notify the user, or any combination thereof.

In use, the invention 100 may be installed behind the electric dryer 900 by separating the exhaust duct 920 from the exhaust outlet 910 of the electric dryer 900, by coupling the tee fitting 200 to the exhaust outlet 910 and to the exhaust duct 920, and by coupling the U-shaped ductwork 210 to the tee fitting 200. After installation, the heated air may pass from the exhaust outlet 910 straight through the tee fitting 200 to the exhaust duct 920 when the first blast gate 240 is open and the second blast gate 242 is closed as though the invention 100 were not there. To redirect the heated air into the building, the user may open the second blast gate 242 and close the first blast gate 240. The heated air may then be diverted through the U-shaped ductwork 210 to the duct flare 222 and into the building with the lint trap 230 and the lint filter 232 preventing the lint from entering the building. The user may partially open and close the first blast gate 240 and the second blast gate 242 to achieve a desired balance of airflow into the building and out of the building. If the first air sensor 250 and/or the second air sensor 252 detect that the pressure at the entrance to the tee fitting 200 or at the entrance to the U-shaped ductwork 210 has exceeded the one or more predetermined pressure thresholds then the first air sensor 250 and/or the second air sensor 252 may initiate an alert to notify the user to intervene. The lint trap 230 and the lint filter 232 may periodically be removed, cleaned, and replaced or exchanged in order to remove the lint that may be collected.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, the words "couple", "couples", "coupled" or "coupling", may refer to connecting, either directly or indirectly, and does not necessarily imply a mechanical connection.

As used herein, the word "desired" may refer to a specific value or action within a range of supported values or action. A "desired" value or action may indicate that a range of values or actions is enabled by the invention and that a user of the invention may select a specific value or action within the supported range of values or actions based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "duct" may be a tube, pipe, canal or channel through which air is conducted or conveyed.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the word "lateral" may refer to the sides of an object or movement towards a side. Lateral directions are generally perpendicular to longitudinal directions. "Laterally" may refer to movement in a lateral direction.

As used in this disclosure, a "port" may be an opening formed in a duct or junction that allows air to flow through the wall of the duct or junction.

As used in this disclosure, a "sensor" may be a device that quantitatively measures a physical stimulus.

As used in this disclosure, a "transducer" may be a device that converts a physical quantity, such as pressure or brightness into an electrical signal or a device that converts an electrical signal into a physical quantity.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A clothes dryer exhaust redirection system comprising:

a tee fitting, U-shaped ductwork, a lint filter, a lint trap, a first blast gate, a second blast gate, a first air sensor, and a second air sensor;

wherein the clothes dryer exhaust redirection system recovers heat from the exhaust of an electric dryer by redirecting the heat into a building where the electric dryer is located;

wherein the tee fitting couples to an exhaust outlet of the electric dryer and directs heated air out of the building via an exhaust duct, into the building via the U-shaped ductwork, or a combination thereof;

wherein the lint trap and the lint filter prevent lint from entering the building.

2. The clothes dryer exhaust redirection system according to claim 1 wherein the tee fitting comprises a tee input port, a first tee output port, and a second tee output port;

wherein the tee input port detachably couples to the exhaust outlet of the electric dryer such that the heated air expelled from the electric dryer enters the tee fitting;

wherein the heated air passes through the tee fitting and exits via the first tee output port, the second tee output port, or both.

3. The clothes dryer exhaust redirection system according to claim 2 wherein the exhaust duct detachably couples to the first tee output port;

wherein the first tee output port is aligned with the tee input port such that the heated air exiting through the first tee output port passes straight through the tee fitting to the first tee output port and is directed out of the building via the exhaust duct.

4. The clothes dryer exhaust redirection system according to claim 3 wherein the second tee output port is oriented to be perpendicular to the tee input port and the central axis of the second tee output port is oriented to be parallel to the floor.

5. The clothes dryer exhaust redirection system according to claim 4 wherein the U-shaped ductwork is coupled to the second tee output port such that the heated air exiting the tee fitting via the second tee output port passes into the U-shaped ductwork;

wherein the U-shaped ductwork directs the heated air to an elevated position behind the electric dryer where the heated air is released into the building.

6. The clothes dryer exhaust redirection system according to claim 5 wherein the U-shaped ductwork comprises a lower lateral duct, a first elbow, a vertical duct, a second elbow, and an upper lateral duct;

wherein the lower lateral duct couples to the second tee output port and is oriented parallel to the floor;

wherein the lower lateral duct directs the heated air from the tee fitting to the first elbow;

wherein the first elbow couples the lower lateral duct to the vertical duct;

wherein the vertical duct is vertically-oriented and directs the heated air up to the second elbow;

wherein the second elbow couples the vertical duct to the upper lateral duct;

wherein the upper lateral duct is horizontally-oriented and directs the heated air back across the rear of the electric dryer.

7. The clothes dryer exhaust redirection system according to claim 6 wherein the distal end of the upper lateral duct terminates at a duct flare;

wherein the duct flare alters the velocity and pressure of the heated air in preparation for releasing the heated air into the building.

8. The clothes dryer exhaust redirection system according to claim 7 wherein the lint filter detachably couples to the duct flare such that the heated air exiting through the duct flare must pass through the lint filter.

9. The clothes dryer exhaust redirection system according to claim 8 wherein the lint filter retains the lint that would otherwise blow into the building.

10. The clothes dryer exhaust redirection system according to claim 9 wherein the lint trap is coupled to the underside of the upper lateral duct;

wherein the lint trap is configured to collect the lint that is blown through the U-shaped ductwork.

11. The clothes dryer exhaust redirection system according to claim 10 wherein the lint trap detaches from the lower lateral duct to empty the lint trap.

12. The clothes dryer exhaust redirection system according to claim 11 wherein the lint trap threadedly couples to a fitting located on the bottom of the upper lateral duct.

13. The clothes dryer exhaust redirection system according to claim 11 wherein the first blast gate is a gate valve that is opened and closed to control the flow of the heated air through the exhaust duct;

wherein the first blast gate is located where the first tee output port couples to the exhaust duct;

wherein the first blast gate is adapted to be opened by a user to pass the heated air from the tee input port to the exhaust duct;

wherein the first blast gate is adapted to be closed by the user to block the heated air from flowing into the exhaust duct.

14. The clothes dryer exhaust redirection system according to claim 13 wherein the second blast gate is a gate valve that is opened and closed to control the flow of the heated air through the U-shaped ductwork;

wherein the second blast gate is located where the second tee output port couples to the U-shaped ductwork;

wherein the second blast gate is adapted to be opened by the user to pass the heated air from the tee input port to the U-shaped ductwork;

wherein the second blast gate is adapted to be closed by the user to block the heated air from flowing into the U-shaped ductwork.

15. The clothes dryer exhaust redirection system according to claim 14 wherein the first air sensor is located on the tee input port such that the first air sensor monitors the heated air flowing into the tee fitting.

16. The clothes dryer exhaust redirection system according to claim 15 wherein the second air sensor is located on the second tee output port such that the second air sensor monitors the heated air flowing out of the tee fitting and into the U-shaped ductwork.

17. The clothes dryer exhaust redirection system according to claim 16 wherein an individual air sensor selected from the first air sensor and the second air sensor monitors the pressure of the heated air that is flowing past the individual air sensor;

wherein the individual air sensor comprises one or more predetermined pressure thresholds that define a range for nominal operating pressure and at least one problematic pressure threshold.

18. The clothes dryer exhaust redirection system according to claim 17 wherein the pressure exceeds the at least one problematic pressure threshold during a blockage of airflow within the clothes dryer exhaust redirection system.

19. The clothes dryer exhaust redirection system according to claim 18 wherein the individual air sensor is adapted to alert the user when the pressure exceeds the at least one problematic pressure threshold.

* * * * *